US008177619B2

(12) United States Patent
Jackson

(10) Patent No.: US 8,177,619 B2
(45) **Date of Patent: *May 15, 2012**

(54) DRAW VS. STUD 3-CARD CASINO POKER GAME

(75) Inventor: Kathleen Nylund Jackson, Scituate, MA (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/844,145

(22) Filed: Jul. 27, 2010

(65) Prior Publication Data

US 2010/0289220 A1 Nov. 18, 2010

Related U.S. Application Data

(63) Continuation of application No. 11/732,248, filed on Apr. 3, 2007, now Pat. No. 7,803,043.

(60) Provisional application No. 60/788,757, filed on Apr. 3, 2006.

(51) Int. Cl.
*A63F 9/24* (2006.01)

(52) U.S. Cl. ..... 463/13; 273/274; 273/292; 273/303; 273/309

(58) Field of Classification Search ..... 273/274, 273/292, 303, 309; 463/13
See application file for complete search history.

(56) References Cited

U.S. PATENT DOCUMENTS 4,836,553 A * 6/1989 Suttle et al. ..... 273/292
4,948,134 A * 8/1990 Suttle et al. ..... 463/13
5,022,653 A * 6/1991 Suttle et al. ..... 463/13
5,100,137 A 3/1992 Fulton
5,167,413 A 12/1992 Fulton
5,224,706 A * 7/1993 Bridgeman et al. ..... 463/13
5,248,142 A * 9/1993 Breeding ..... 273/138.1
5,251,897 A 10/1993 Fulton
5,280,915 A * 1/1994 Groussman ..... 273/292
5,288,081 A * 2/1994 Breeding ..... 273/292
5,322,295 A 6/1994 Cabot et al.
5,324,035 A 6/1994 Morris et al.
5,374,067 A * 12/1994 Jones ..... 273/292
5,411,257 A 5/1995 Fulton
5,417,430 A * 5/1995 Breeding ..... 273/292
5,431,408 A 7/1995 Adams
5,437,451 A 8/1995 Fulton
5,437,462 A * 8/1995 Breeding ..... 273/292
5,486,005 A * 1/1996 Neal ..... 273/292
5,489,101 A * 2/1996 Moody ..... 273/292
5,531,448 A 7/1996 Moody
5,540,444 A * 7/1996 Nguyen ..... 273/292
5,544,892 A * 8/1996 Breeding ..... 273/292
5,560,613 A * 10/1996 Nguyen ..... 273/292
5,584,486 A * 12/1996 Franklin ..... 273/292
5,605,334 A * 2/1997 McCrea, Jr. ..... 273/309
5,636,842 A 6/1997 Cabot et al.
5,645,281 A * 7/1997 Hesse et al. ..... 273/292
5,678,821 A * 10/1997 Hedman ..... 273/292
5,702,106 A * 12/1997 Alvarez, Jr. ..... 273/292
5,718,430 A * 2/1998 Aramapakul et al. ..... 273/292
5,725,215 A 3/1998 Hesse
5,732,950 A 3/1998 Moody
5,735,525 A * 4/1998 McCrea, Jr. ..... 273/309
5,755,621 A 5/1998 Marks et al.
5,762,340 A 6/1998 Feola
5,799,945 A * 9/1998 Boylan et al. ..... 273/292
5,803,460 A * 9/1998 Hesse ..... 273/292
5,803,809 A 9/1998 Yoseloff
5,806,854 A * 9/1998 Coleman et al. ..... 273/292
5,816,915 A 10/1998 Kadlic
5,820,128 A * 10/1998 Brunelle ..... 273/292
5,820,460 A 10/1998 Fulton
5,823,873 A 10/1998 Moody
5,823,875 A * 10/1998 Tarantino ..... 463/29
5,829,750 A * 11/1998 Booker ..... 273/292
5,833,536 A 11/1998 Davids et al.
5,839,732 A * 11/1998 Guidi ..... 273/292
5,851,011 A 12/1998 Lott
5,857,678 A * 1/1999 Coleman et al. ..... 273/292
5,863,041 A * 1/1999 Boylan et al. ..... 273/292
5,882,259 A 3/1999 Holmes, Jr. et al.
5,885,157 A 3/1999 Harada et al.
5,901,958 A * 5/1999 Andrews ..... 273/292
5,908,353 A 6/1999 Andrews
5,911,418 A 6/1999 Adams
5,911,419 A * 6/1999 Delaney et al. ..... 273/292
5,951,012 A * 9/1999 Feola ..... 273/292
5,954,335 A 9/1999 Moody (Continued)

*Primary Examiner* — Gene Kim
*Assistant Examiner* — Alexander Niconovich
(74) *Attorney, Agent, or Firm* — K&L Gates LLP

(57) ABSTRACT

A method of playing a wagering card game for a single player or a number of players using standard playing cards having a standard rank and involving standard poker hand rankings or modified rankings for Three Card Poker® games. The players play a draw poker game against a dealer's stud poker hand. Each player's hand contains fewer cards than the dealer's hand, but the game is resolved with final hands of equal amount of cards. After an Ante wager, a plurality of cards is dealt to each player, and a plurality of cards is dealt to the dealer. Following predetermined house rules, each player then may decide to execute one or more of the following options: Surrender, Fold, make a Play bet, make a Double Down bet, or make a Draw bet. The player may or may not discard a card to make the Draw bet. After all of the players' hands have been fully executed, the dealer then adds one or more additional face-up cards to his hand. Outcomes of a comparison of hands are determined by traditional poker rules and standard poker rankings. Wagers are then resolved according to a predetermined paytable.

14 Claims, No Drawings

U.S. PATENT DOCUMENTS

| | | | | |
|---|---|---|---|---|
| 5,957,774 | A | 9/1999 | Holmes, Jr. et al. | |
| 5,976,016 | A | 11/1999 | Moody et al. | |
| 5,984,310 | A | 11/1999 | English | |
| 5,997,002 | A * | 12/1999 | Goldman | 273/292 |
| 6,007,066 | A | 12/1999 | Moody | |
| 6,012,719 | A * | 1/2000 | Webb | 273/292 |
| 6,012,720 | A * | 1/2000 | Webb | 273/292 |
| 6,050,658 | A | 4/2000 | O'Sullivan et al. | |
| 6,062,979 | A | 5/2000 | Inoue | |
| 6,095,525 | A * | 8/2000 | Terminel | 273/274 |
| 6,098,985 | A | 8/2000 | Moody | |
| 6,120,378 | A | 9/2000 | Moody et al. | |
| 6,131,907 | A * | 10/2000 | Nucifora et al. | 273/292 |
| 6,135,883 | A | 10/2000 | Hachquet | |
| 6,146,271 | A | 11/2000 | Kadlic | |
| 6,189,888 | B1 * | 2/2001 | Brunelle | 273/292 |
| 6,196,547 | B1 | 3/2001 | Pascal et al. | |
| 6,220,597 | B1 * | 4/2001 | Scibetta | 273/292 |
| 6,237,916 | B1 | 5/2001 | Webb | |
| 6,286,834 | B1 | 9/2001 | Caputo | |
| 6,311,976 | B1 | 11/2001 | Yoseloff et al. | |
| 6,311,978 | B1 | 11/2001 | Moody | |
| 6,328,649 | B1 | 12/2001 | Randall et al. | |
| 6,332,614 | B1 | 12/2001 | Hesse | |
| 6,334,613 | B1 | 1/2002 | Yoseloff | |
| 6,402,147 | B1 | 6/2002 | Lo | |
| 6,406,023 | B1 | 6/2002 | Rowe | |
| 6,406,369 | B1 | 6/2002 | Baerlocher et al. | |
| 6,413,161 | B1 | 7/2002 | Baerlocher et al. | |
| 6,419,578 | B1 | 7/2002 | Moody et al. | |
| 6,425,824 | B1 | 7/2002 | Baerlocher et al. | |
| 6,474,644 | B1 | 11/2002 | Pickle et al. | |
| 6,517,074 | B1 | 2/2003 | Moody et al. | |
| 6,533,279 | B2 | 3/2003 | Moody et al. | |
| 6,533,658 | B1 | 3/2003 | Walker et al. | |
| 6,561,898 | B2 | 5/2003 | Moody | |
| 6,568,680 | B1 | 5/2003 | Moody et al. | |
| 6,575,830 | B2 | 6/2003 | Baerlocher et al. | |
| 6,585,591 | B1 | 7/2003 | Baerlocher et al. | |
| 6,634,943 | B1 | 10/2003 | Baerlocher | |
| 6,638,164 | B2 | 10/2003 | Randall et al. | |
| 6,652,377 | B1 | 11/2003 | Moody | |
| 6,672,959 | B2 | 1/2004 | Moody et al. | |
| 6,688,975 | B2 | 2/2004 | Baerlocher et al. | |
| 6,698,759 | B2 | 3/2004 | Webb et al. | |
| 6,722,983 | B2 | 4/2004 | Kaminkow et al. | |
| 6,726,427 | B2 | 4/2004 | Jarvis et al. | |
| 6,729,961 | B1 | 5/2004 | Millerschone | |
| 6,733,386 | B2 | 5/2004 | Cuddy et al. | |
| 6,780,110 | B2 | 8/2004 | Baerlocher et al. | |
| 6,796,899 | B2 | 9/2004 | Baerlocher | |
| 6,802,775 | B2 | 10/2004 | Baerlocher et al. | |
| 6,827,348 | B1 | 12/2004 | Mitchell | |
| 6,837,793 | B2 | 1/2005 | McClintic | |
| 6,840,856 | B2 | 1/2005 | Stern | |
| 6,860,810 | B2 | 3/2005 | Cannon et al. | |
| 6,866,584 | B2 | 3/2005 | Michaelson | |
| 6,902,478 | B2 | 6/2005 | McClintic | |
| 6,910,962 | B2 | 6/2005 | Marks et al. | |
| 6,913,533 | B2 | 7/2005 | Cuddy et al. | |
| 6,913,535 | B2 | 7/2005 | Kaminkow et al. | |
| 6,938,900 | B2 | 9/2005 | Snow | |
| 6,955,356 | B2 | 10/2005 | Moody | |
| 6,959,928 | B2 | 11/2005 | Schultz | |
| 6,964,418 | B2 | 11/2005 | Moody | |
| 6,969,316 | B2 | 11/2005 | Jarvis et al. | |
| 6,971,954 | B2 | 12/2005 | Randall et al. | |
| 6,971,955 | B2 | 12/2005 | Baerlocher et al. | |
| 6,979,263 | B2 | 12/2005 | Baerlocher et al. | |
| 6,986,710 | B2 | 1/2006 | Baerlocher et al. | |
| 6,988,946 | B2 | 1/2006 | Michaelson et al. | |
| 6,991,538 | B2 | 1/2006 | Cannon | |
| 6,994,624 | B2 | 2/2006 | Gold et al. | |
| 7,004,836 | B2 | 2/2006 | Kaminkow et al. | |
| 7,037,192 | B2 | 5/2006 | Baerlocher et al. | |
| 7,052,392 | B2 | 5/2006 | Tessmer et al. | |
| 7,056,213 | B2 | 6/2006 | Ching et al. | |
| 7,059,965 | B2 | 6/2006 | Jackson | |
| 7,074,127 | B2 | 7/2006 | Cuddy et al. | |
| 7,077,744 | B2 | 7/2006 | Cannon | |
| 7,090,580 | B2 | 8/2006 | Rodgers et al. | |
| 7,094,148 | B2 | 8/2006 | Baerlocher et al. | |
| 7,104,886 | B2 | 9/2006 | Baerlocher et al. | |
| 7,137,628 | B2 | 11/2006 | Moody | |
| 7,153,205 | B2 | 12/2006 | Baerlocher | |
| 7,153,207 | B2 | 12/2006 | Kaminkow et al. | |
| 7,153,208 | B2 | 12/2006 | Kaminkow et al. | |
| 7,156,397 | B2 | 1/2007 | Moody et al. | |
| 7,156,737 | B2 | 1/2007 | Kaminkow et al. | |
| 7,160,186 | B2 | 1/2007 | Cuddy et al. | |
| 7,192,348 | B2 | 3/2007 | Brosnan et al. | |
| 7,195,243 | B2 | 3/2007 | Kenny et al. | |
| 7,201,657 | B2 | 4/2007 | Baerlocher et al. | |
| 7,204,754 | B2 | 4/2007 | Gray et al. | |
| 7,210,997 | B2 | 5/2007 | Hughs-Baird et al. | |
| 7,220,180 | B2 | 5/2007 | Kaminkow et al. | |
| 7,222,857 | B2 | 5/2007 | Moody | |
| 7,222,858 | B2 | 5/2007 | Moody | |
| 7,235,011 | B2 | 6/2007 | Randall et al. | |
| 7,247,092 | B2 | 7/2007 | Jarvis et al. | |
| 7,264,243 | B2 | 9/2007 | Yoseloff et al. | |
| 7,291,069 | B2 | 11/2007 | Michaelson et al. | |
| 7,297,057 | B2 | 11/2007 | Gerrard et al. | |
| 7,314,408 | B2 | 1/2008 | Cannon | |
| 7,314,410 | B2 | 1/2008 | Baerlocher et al. | |
| 7,329,183 | B2 | 2/2008 | Michaelson | |
| 7,331,862 | B2 | 2/2008 | Rodgers et al. | |
| 7,331,866 | B2 | 2/2008 | Rodgers et al. | |
| 7,338,364 | B2 | 3/2008 | Baerlocher et al. | |
| 7,354,344 | B2 | 4/2008 | Paulsen et al. | |
| 7,357,713 | B2 | 4/2008 | Marks et al. | |
| 7,357,714 | B2 | 4/2008 | Tessmer et al. | |
| 7,361,087 | B2 | 4/2008 | Baerlocher et al. | |
| 7,364,161 | B2 | 4/2008 | Lo | |
| 7,367,563 | B2 | 5/2008 | Yoseloff et al. | |
| 7,371,169 | B2 | 5/2008 | Baerlocher | |
| 7,371,170 | B2 | 5/2008 | Cregan et al. | |
| 7,387,300 | B2 | 6/2008 | Snow | |
| 7,387,568 | B2 | 6/2008 | Millerschone | |
| 7,390,258 | B2 | 6/2008 | Millerschone | |
| 7,393,276 | B2 | 7/2008 | Millerschone | |
| 7,399,227 | B2 | 7/2008 | Michaelson et al. | |
| 7,399,228 | B2 | 7/2008 | Baerlocher | |
| 7,404,762 | B2 | 7/2008 | Moody | |
| 7,410,172 | B1 | 8/2008 | Muskin | |
| 7,419,162 | B2 | 9/2008 | Lancaster et al. | |
| 7,431,644 | B2 | 10/2008 | Moody | |
| 7,455,588 | B2 | 11/2008 | Webb et al. | |
| 7,458,582 | B2 | 12/2008 | Snow et al. | |
| 7,470,183 | B2 | 12/2008 | Wishart | |
| 7,473,176 | B2 | 1/2009 | Michaelson | |
| 7,479,062 | B2 | 1/2009 | Michaelson | |
| 7,481,708 | B2 | 1/2009 | Baerlocher et al. | |
| 7,488,251 | B2 | 2/2009 | Kaminkow | |
| 7,803,041 | B2 * | 9/2010 | Gold et al. | 463/13 |
| 2001/0024015 | A1 | 9/2001 | Hogan et al. | |
| 2002/0089120 | A1 | 7/2002 | Miller | |
| 2002/0195775 | A1 | 12/2002 | Webb et al. | |
| 2003/0125107 | A1 | 7/2003 | Cannon | |
| 2003/0130024 | A1 | 7/2003 | Darby | |
| 2003/0168808 | A1 | 9/2003 | Jones et al. | |
| 2004/0002376 | A1 | 1/2004 | Swift et al. | |
| 2004/0048649 | A1 | 3/2004 | Peterson et al. | |
| 2004/0048673 | A1 | 3/2004 | Kaminkow | |
| 2004/0053669 | A1 | 3/2004 | Gerrard et al. | |
| 2004/0063489 | A1 | 4/2004 | Crumby | |
| 2004/0150163 | A1 | 8/2004 | Kenny et al. | |
| 2004/0217548 | A1 | 11/2004 | Snow | |
| 2004/0219970 | A1 | 11/2004 | Tarantino | |
| 2004/0224770 | A1 | 11/2004 | Wolf et al. | |
| 2005/0026665 | A1 | 2/2005 | Gerrard et al. | |
| 2005/0029741 | A1 | 2/2005 | Snow et al. | |
| 2005/0033461 | A1 | 2/2005 | Gerrard et al. | |
| 2005/0037834 | A1 | 2/2005 | Stern et al. | |
| 2005/0037840 | A1 | 2/2005 | Baerlocher | |
| 2005/0059446 | A1 | 3/2005 | Kaminkow | |
| 2005/0059455 | A1 | 3/2005 | Gerrard et al. | |

2005/0082760 A1 4/2005 Yoseloff et al.
2005/0202863 A1 9/2005 Macaulay
2006/0017225 A1 1/2006 Nicely
2006/0052148 A1 3/2006 Blair, Jr. et al.
2006/0063578 A1 3/2006 Bansemer et al.
2006/0063582 A1 3/2006 Baerlocher et al.
2006/0066051 A1 3/2006 Nicely
2006/0068866 A1 3/2006 White et al.
2006/0068882 A1 3/2006 Baerlocher et al.
2006/0073877 A1 4/2006 Rodgers et al.
2006/0084494 A1 4/2006 Belger et al.
2006/0084506 A1 4/2006 Yoseloff et al.
2006/0094509 A1 5/2006 Michaelson et al.
2006/0131810 A1 6/2006 Nicely
2006/0154714 A1 7/2006 Montross et al.
2006/0172791 A1 8/2006 Wolf
2006/0199636 A1 9/2006 Ching et al.
2006/0199637 A1 9/2006 Ching et al.
2006/0246977 A1 11/2006 Cannon
2006/0267283 A1 11/2006 Jackson
2006/0270477 A1 11/2006 Snow
2007/0018398 A1 1/2007 Kao
2007/0021188 A1 1/2007 Rodgers et al.
2007/0032285 A1 2/2007 Wolf
2007/0054721 A1 3/2007 Jackson
2007/0060240 A1 3/2007 White
2007/0060241 A1 3/2007 Low et al.
2007/0060294 A1 3/2007 Cuddy et al.
2007/0082725 A1 4/2007 Low et al.
2007/0111783 A1 5/2007 Cuddy et al.
2007/0135193 A1 6/2007 Nicely
2007/0135194 A1 6/2007 Nicely et al.
2007/0149270 A1 6/2007 Baerlocher et al.
2007/0155480 A1 7/2007 Brosnan et al.
2007/0228656 A1 10/2007 Jackson
2007/0254732 A1 11/2007 Walker et al.
2007/0296151 A1 12/2007 Kyrychenko
2007/0298854 A1 12/2007 Yoseloff et al.
2008/0026806 A1 1/2008 Gold et al.
2008/0026813 A1 1/2008 Cannon
2008/0032764 A1 2/2008 Cannon
2008/0051169 A1 2/2008 Michaelson et al.
2008/0064462 A1 3/2008 Gerrard et al.
2008/0108401 A1 5/2008 Baerlocher et al.
2008/0111309 A1 5/2008 Nicely et al.
2008/0113704 A1 5/2008 Jackson
2008/0113763 A1 5/2008 Michaelson et al.
2008/0113765 A1 5/2008 DeWaal
2008/0119257 A1 5/2008 Stern et al.
2008/0139298 A1 6/2008 Rodgers et al.
2008/0167108 A1 7/2008 Baerlocher et al.
2008/0188278 A1 8/2008 Paulsen et al.
2008/0200232 A1 8/2008 Baerlocher et al.
2008/0207305 A1 8/2008 Cregan et al.
2008/0214255 A1 9/2008 Jarvis et al.
2008/0214283 A1 9/2008 Cregan et al.
2008/0234034 A1 9/2008 Tessmer et al.
2008/0252011 A1 10/2008 Bickley et al.

* cited by examiner

DRAW VS. STUD 3-CARD CASINO POKER GAME

PRIORITY CLAIM

This application is a continuation of, claims priority to and the benefit of U.S. patent application Ser. No. 11/732,248, now U.S. Pat. No. 7,803,043 filed on Apr. 3, 2007, which claims the benefit of and priority to U.S. Provisional Application No. 60/788,757, filed Apr. 3, 2006, the entire of contents of each of which are incorporated by reference herein.

BACKGROUND

The present invention relates to a poker game suitable for use in casinos and other gaming establishments as a table card game or a video poker game. The invention further relates to casino gaming wherein a player may play a draw poker game against a house stud poker hand in a wagering game.

Games based upon variations of poker have attained enormous popularity as casino-type entertainment games, particularly in the last twenty years. The success of poker games in the gaming industry is partially based on the game's simplicity (i.e., there is widespread public knowledge of the game rules) and the fact that players feel more directly involved in exercising judgment in the play of the game.

Traditional poker as played in card rooms and casinos allow players to compete head to head against other players. The casino typically charges a fee or vigorish for the privilege to play at the table, and so is one of the rare wagering games in which the casino does not have a built-in percentage advantage per game.

Many new approaches to poker have been developed for casino table games that can be played on a blackjack-like table, in which the players compete against the house or against a paytable, and in which the house has an edge or percentage advantage. These poker variations now rival the popularity of blackjack in many venues. Let It Ride™, one of the first variants to gain popularity, is a version of 5-card stud played against a paytable that requires a three-part bet, and allows the withdrawal of up to two parts of the total bet after viewing certain cards. The downside of the game for the player is that simple strategy rules determine whether the player should withdraw part of the wager, so there is a lack of involvement and risk-taking decisions that typify the casino poker player.

Caribbean Stud Poker® game is also a 5-card stud game, but is played against the dealer's qualified hand and a paytable. The dealer must have a specified minimum hand to qualify, so that there is consternation for the player who holds a premium hand and is not allowed to capitalize on it. An optional side bet can be placed to qualify for a progressive jackpot, but the high casino advantage on this wager may discourage the player.

Three Card Poker® game is actually two games in one. Both games are based on hands consisting of three cards and the player may bet on either one, both, and in different amounts. Play begins with a wager on ante. After the player views his three cards he may either raise by putting an equal bet on play or fold and lose the ante bet. If the player does raise then he goes against the dealer's hand. The dealer needs at least a queen high to qualify. The Pair Plus™ wager is a simple side bet in which the player gets the three cards and is paid according to their value. The dealer's hand is immaterial. There is no raising and no discarding. Dealer qualification can be problematic in this poker variation as in Caribbean Stud Poker game, and the Pair Plus™ wager in fact requires no skill of any kind and so does not excite the decision-making player.

The Four Card Poker™ game is akin to the Three Card Poker® game, but as the name signifies, four cards are used instead of three. Other key differences are that there is no dealer qualifying hand, and the player can raise up to three times his ante. The dealer gets one extra card to form his best hand. The object of the game is for the player to form a four-card poker hand higher than, or equal in rank to the dealer's hand. Players use their best four of five cards dealt against the dealer's best four of six cards. However, players may have the perception that the dealer always has the upper hand, since the dealer gets the additional card.

3-5-7 Poker® game is a simple poker-based game that is actually a three-games-in-one wherein the player bets on both 3-card and 5-card hands, and may also bet on a 7-card poker hand, with payoffs set by a standard pay table. Since the 7-card hand usually has the lowest house advantage, all three games should generally be played. Unfortunately for the player, a poor 3-card hand will more likely determine poor 5- and 7-card hands, so the player may have almost no positive anticipation and end up losing all three hands.

There is a need to address these cited shortcomings so that the player is offered a quick and compelling poker table game that does not require dealer qualification and allows the player a decision-making process that encourages the player to play at a comfortable risk level.

U.S. Pat. No. 6,959,928 (Schultz) describes a poker-type game capable of providing a dealer with an initial advantage and a player with a subsequent advantage. From a predetermined number of cards, a dealer is assigned an initial hand having a greater poker value than an initial hand assigned to a player. Subsequently, a dealer receives a number of cards to complete the dealer's hand, and the player receives a number of cards to complete the player's hand, wherein a predetermined poker advantage is conveyed to the predetermined number of cards to complete the player's hand.

U.S. Pat. No. 6,938,900 (Snow) describes a method of playing a wagering card game involving at least four distinct wagering parts and dealing three cards to each player and at least two common cards. Players are allowed to withdraw parts of the initial wager at various distinct points in the game.

U.S. Pat. No. 6,860,810 (Cannon) discloses a gaming apparatus and methods of conducting a wagering game of chance. A gaming machine is disclosed which is configured for mutually concurrent play of a plurality of games of chance on a single display screen.

U.S. Pat. No. 6,827,348 (Mitchell) describes a playing card wagering game method that involves each player wagering an initial blind bet against the dealer and an optional premium odds side bet for premium dealt hands having a rank equal to a pair of aces or higher rank within the first five cards players are dealt, resulting in a payout of six to one. Each player and the dealer are dealt five cards in succession face down. Two common cards are dealt face down in succession. Dealer turns dealer's dealt hand face up to reveal rank of cards. Players elect to hold on their dealt hands for higher odds payout of two to one or place a draw bet equal to their initial bet to include the use of the two common cards in play to improve their hands, resulting in payouts of even odds for using the first common card and one half odds, one for two, for using the second common card. Dealer turns first and second common cards face up. Dealer always uses dealer's dealt hand and both common cards to make highest ranked poker hand possible. Dealer turns players' cards face up declares rank of all hands, and resolves all wagers.

U.S. Pat. No. 6,402,147 (Lo) describes a seven-card-stud poker game, played by two to seven players with at least one standard poker deck of 52 cards plus at least one Joker. One of the players is the Banker. A Player who is not a Banker may play Poker Bet, playing against the Banker's hand and/or one to seven side bets betting on the contents of the Player's own hand. After a wager is placed, each Player and the Banker are each dealt seven cards. The Players and the Banker each then selects his best 5-card poker hand from his seven cards and discards two cards. To win a Poker Bet wager, a Player's best 5-card poker hand must rank higher than the Banker's best 5-card poker hand. To win a side-bet wager, a Player's best 5-card poker hand must be one of the predetermined winning hands of the type of the side bet he bets on. The Poker Bet wager and seven side-bet wagers are independent wagers and are settled separately.

U.S. Pat. No. 6,332,614 (Hesse) describes a method of playing a Poker card game between a Dealer and at least one player wherein the Dealer receives two Poker hands and each of said at least one player receives one Poker hand. Upon evaluation, the player is determined to be the winner if the player hand is ranked higher than both of said dealer hands, and determining, upon said evaluation, the dealer to be the winner of the hand if either one of the dealer hands are ranked higher than the player hand.

U.S. Pat. No. 5,984,310 (English) describes a method of playing a casino type wagering card game includes the initial step of each player placing an initial wager. Five cards are then dealt to each player and seven cards are dealt to the dealer. Each player may then inspect the original dealt hand, and elect to stay pat or discard and draw one or two cards. If the player elects to draw, they then inspect the new draw hand and either fold or place a second wager to stay with the draw hand. All discarded cards are then collected by the dealer and the dealer selects the best five card hand, based on poker criteria, from the dealer's cards. A comparison is then made between the player's hand and the dealer's selected hand. If the player stayed pat and has a hand higher than the dealer's hand, the player is awarded odds on the initial wager. If the player stays with the draw hand, and has a hand higher than the dealer's hand, the player is awarded even money on the initial wager and the second wager. If the dealer's hand is higher than the player's hand, the player loses the initial wager and the second wager if applicable. If the player's hand and the dealer's hand are the same rank, a "push" will result, and the player neither wins nor loses money.

U.S. Pat. No. 5,851,011 (Lott) relates generally to a casino-type method of playing poker wherein one or more players play a single hand against the house. It relates more particularly to a multi-deck method of playing a poker-like game wherein multiple players progressively wager on a single five-card player hand which is matched against a later-dealt best-five-of-seven card dealer hand, the winning hand being determined by traditional rules of poker.

U.S. Pat. No. 5,762,340 (Feola) provides various methods of playing a card game wherein the amount of successive wagers is pre-established. Each hand is preceded by players making at least one initial wager. A dealer then provides himself/herself with a plurality of cards and each player with at least one card to form an initial partial hand. The players are given the opportunity to view their initial partial hands and are then required to increase their wagers by a predetermined amount in order to continue playing that hand. If the player increases his/her wager by the predetermined amount, then the player will receive at least one additional card. Various embodiments require subsequent wagers in different amounts.

U.S. Patent Application No. 20050082760 (Yoseloff) describes a game comprising: each player placing at least one wager; dealing a first number of cards to a dealer as a banker's hand, the first number of cards being greater than the number of cards to be used in determination of a poker rank hand for the banker's hand; dealing a second number of cards to each player, the second number of cards being greater than the number of cards to be used in determination of a poker rank hand for each player; the dealer discarding at least one card from the banker's hand to form a resulting single dealer hand; each player discarding at least one card to form a resulting player's hand for each player, wherein the number of cards in resulting player's hands and the resulting banker's hand are equal; and resolving each player hand against the banker's hand according to predetermined game rules. The initial player's wagers must be at least matched with a Game Bet (or play bet of 1.times. or more of the Ante) to remain in the game after players have received their cards. The Game Bet multiple is selected by the player.

U.S. Patent Application No. 20050001378 (Lo) describes mainly a 7-card stud poker game, played with at least one standard poker deck of 52 cards, plus at least one Joker. After a player places a Poker wager and/or a Pair Of Aces Or Better wager, the player then has the option to place a Bonus wager, against a banker. Each said wager automatically wins if the player is dealt a 7-Card 9 High hand or a 7-Card Straight Flush; otherwise, the player's Poker wager wins if the player's best 5-card poker hand ranks higher than or the same as the banker's best 5-card poker hand; the player's Pair Of Aces Or Better wager wins if the player's best 5-card poker hand is a pair of Aces or better; the player's Bonus wager wins if the player's best 5-card poker hand ranks higher than or the same as the banker's with a predetermined hand or better.

U.S. Patent Application No. 20040219970 (Tarantino) describes a multi-hand poker game comprising the play of a plurality of poker hands as part of the same game. The game includes the step of selecting and assigning a set of poker rules to apply to each hand. Each poker hand is formed and the outcome of each hand is determined by comparison to the set of rules which was selected for that hand.

U.S. Patent Application No. 20030168808 (Jones) describes methods of playing card games include the steps of (a) affording each player an opportunity to place an ANTE wager to participate in the game; (b) affording each player an opportunity to make an optional BONUS BET wager; (c) dealing three cards to each player and to a dealer; (d) affording each player an opportunity to view their cards; (e) affording each player an opportunity to either fold and forfeit their ANTE wager, or call by making a BET wager (f) evaluating whether the dealer's hand qualifies by achieving a predetermined point value; and (g) settling wagers by (1) if the dealer's hand does not qualify, paying the ANTE wagers and refunding the BET wagers to each remaining player and paying each remaining player who opted to make the BONUS BET wager an amount determined by a predetermined pay table based on a point value of the player's hand; (2) if the dealer's hand does qualify, comparing each remaining player's hand with the dealer's hand using point value as the criterion for comparison, (I) wherein if the dealer wins the hand the house wins the ANTE and BET wagers and pays to each remaining player who opted to make the BONUS BET wager an amount determined by a predetermined pay table based on the point value of the player's hand; and (II) wherein if a player wins the hand, the player wins the ANTE wager and is paid on the BET wager an amount according to a predetermined pay table based on the point value of the player's hand and the house pays to each remaining player who opted to make the BONUS BET wager an amount determined by a predetermined pay table based on the point value of the player's hand.

In Published U.S. Patent No. 20040150163 (Kenny), a poker-type game is taught wherein one or more players initially place a wager(s) and then five cards are dealt to the player and five cards are dealt to the dealer. Players would inspect their hands and decide whether to fold or to continue to play. If the player was playing a wager against the dealer and wanted to continue to play, they would place another wager in support of their first wager in the appropriate betting area. The dealer would inspect his/her hand to see if they qualified. If the dealer did not qualify with a pre-determined rank of cards, the dealer would pay the first wager of the player and return the supporting wager. If the dealer had a qualifying hand, then the player and the dealer would compare their best four-card hand to determine the winner. Tie hands would be a push. If the player had also made a wager against the dealer and had supported that wager, and the player's outranks the dealer, they would be eligible for a payoff for achieving a winning hand. If the player had also made any wagers against achieving a predetermined rank, and achieves such a rank, the player would win that wager accordingly. In a second embodiment of the Kenny game, one or more players initially place bets and then five cards are dealt to the player and six cards are dealt to the dealer. Players would inspect their hands and decide whether to fold or to continue to play. If the player was playing a wager against the dealer and wanted to continue to play, they would place another wager in support of their first wager in the appropriate betting area. In games against the dealer, the player would play their best four-cards out of five and compare that to the dealer's best four cards out of six to determine the winner. Tie hands would be a push. In this version the dealer would not have to have a qualifying hand to continue play. If the player had made any optional wagers against achieving a pre-determined rank, the dealer would pay or take the wagers accordingly.

Each of the references discussed in this text are incorporated herein in their entirety for all purposes.

It is an ever-increasing challenge to provide players with new and enticing gameplay features that will stimulate player interest and increase time at the table or the machine.

SUMMARY

A method of playing a wagering card game for a single player or a number of players uses standard playing cards having a standard rank and involving standard poker hand rankings: The players play a draw poker game against a dealer's stud poker hand. Each player's hand contains fewer cards than the dealer's hand, but the game is resolved with final hands of equal amount of cards.

The game begins with each player making a wager (or Ante). A plurality of cards is dealt face down to each player, and a plurality of cards is dealt face up to the dealer. Each player views and assesses his cards against the strength of the shown dealer cards. Following predetermined house rules, each player then may decide to execute one or more of the following options: Surrender, Fold, make a Play bet, make a Double Down bet, or make a Draw bet. The player may or may not have to discard a card to make the Draw bet. After all of the players' hands have been fully executed, the dealer then adds additional face-up cards to his stud hand. The player and the dealer hands are then compared by looking at "best-of" hands; for example, if a 3-card poker game is being played, then the player's initially dealt 3-card hand (or best 3-of-4 cards if a Draw bet was made) is compared to the dealer's best 3-of-5 card hand as determined by standard poker rankings. Outcomes of the comparisons are determined by traditional poker rules and standard poker rankings. Wagers are then resolved according to a predetermined paytable.

The preferred method is a 3-card poker game that gives the player options and decision-making opportunities. In addition, the dealer hand always qualifies. Since it is a 3-card game, the play is fast, and the dealing and wager-resolution are easy. Each player makes a wager to begin the game. Each player is then dealt 3 cards face down, and the dealer is dealt an initial partial hand of 2 cards face up. After evaluating his own cards, each player is then prompted to do one of the following: Fold, Double Down, or Draw one card. Doubling or drawing requires an additional wager of at least 1:1 of the original wager. If the player makes a Draw wager, he is dealt one additional card, and his final hand for comparison purposes is the best 3-of-4 according to standard poker rankings. All player hands are revealed. The dealer then adds 3 additional face-up cards to his initial partial hand, for a total of a 5-card stud hand. The best 3-of-5 dealer hand is determined according to standard poker rankings and shown, and compared to all the active 3-card player hands. The higher poker hand according to standard poker ranking rules wins. The wager bet (or Doubled bet) is resolved according to a paytable that begins with a specified minimum rank, preferably at least a Pair. The Draw bet pays 1:1.

A less risky and volatile game would allow a Surrender event for 50% payback, Playing the wager as is, Doubling the wager, or Drawing for an additional wager. Yet another game play would allow an initial Ante bet and the options to Fold or make a Play bet. If the Play bet is made, the player would then also have the options to Double the Play bet, or make a Draw bet. The invention may also be played with the above described betting options as a 5-card draw game against a 7-card stud game. The player may start with a partial initial hand, then pay to Draw the full hand, or the player may be dealt a full hand, and then discard and Draw. The dealer hand would be the best 5-of-7.

DETAILED DESCRIPTION OF THE INVENTION

A method of playing a wagering card game for a single player or a number of players (at a casino table, virtual table or internet connection) may use standard playing cards or virtual playing cards comprising at least a standard rank and the game involving standard poker hand rankings. It is also possible to include wild cards or special bonus cards into the game. The players place at least an initial wager and possibly a bonus wager, and then play a draw poker game against a dealer's stud poker hand. Each player's hand at one point in the play of the game contains fewer total cards than the total number of cards in the dealer's hand, but the game is resolved with ranks determined on the basis of final hands of a specific and equal number of cards. The player and the dealer hands are then compared by looking at "best-of" hands; for example, if a 3-card poker game is being played, then the player's initially dealt 3-card hand (or best 3-of-4 cards if a Draw bet was made) is compared to the dealer's best 3-of-5 card hand as determined by standard poker rankings. One method of play is a game wherein the final hands for resolution each consist of 3 cards.

The games according to the present disclosure may be provided as a video poker game or a live or hybrid casino table game. By hybrid systems is meant those systems known in the art where there may be a fully automated gaming table, such as the Shuffle Master, Inc. Multi-Player Platform system or a system with a dealer and automated bet recognitions and card reading and/or display, or even virtual wagers. The wager may be provided in a casino table card game with chips, tokens, money, credit, wagered credits or credit charge. The wager in a video game is usually made with credits or credit charges.

The following discussion describes methods and rules of play that may be used in the practice of the present invention. Samples of the rules for the different games are provided below as examples, but not as limitations in the practice of the game. Samples of paytables for the different games are also provided below as examples, but not as limitations in the practice of the game.

Version A: 3-Card Poker Rules for 7 Players

1. Player makes at least one BET to play game. A bonus wager may be mandatory or optional, as for example against a paytable for a final rank or count value of a hand against the paytable.

2. Each player gets 3 cards face down. Dealer gets 2 cards face up. (The deal is usually started with one card each to first base player, then the next players, then the dealer, and ends with the last or "third base" player.)

3. Each player is then prompted to do at least one of the following:

A. FOLD (lose BET)

B. DOUBLE the bet (placing at risk an additional amount that is the same amount as BET, or another multiple of the BET. The player may provide an option of 1×, 2×, 3×, 4×, etc. of the BET amount)

C. Make a DRAW bet (placing at risk an additional amount that is the same as amount BET, or a multiple as explained directly above)

4 If the player has FOLDED, the dealer immediately removes the player's BET(s) and cards.

5. After all the betting is complete, each remaining player discloses all cards, e.g., flips over his cards.

6. If the player has DOUBLED his bet, his 3-card hand is in play.

7. If the player has made a DRAW bet, he gets one additional card, either before or after disclosing all cards, and his hand is determined as the best-3-of-4 cards.

8. If the draw hand does not contain at least a pair, the hand loses and the dealer removes both bets and the player's cards.

9. Dealer attends to all player hands, and then flips over an additional 3 cards in his stud hand. All active hands go up against the dealer's best-3-of-5 card stud hand.

10. PAYOFFS:

BET pays multiples according to predetermined paytable.

DOUBLE pays 2× the BET multiples according to predetermined paytable.

DRAW pays 1 to 1.

Sample Paytable for Version A:

Rank Odds on BET:

PAIR 2:1

STRAIGHT 3:1

FLUSH 3:1

THREE-OF-A-KIND 6:1

STRAIGHT FLUSH 8:1

A-K-Q SUITED 10:1

Version B: 3-Card Poker Rules for 7 Players

1. Player makes a BET to play game.

2. Each player gets at least an initial 3 cards face down. Dealer gets 2 cards face up. (The deal starts with one card each to first base player, then the next players, then the dealer, and end with the last or "third base" player.)

3. Each player is prompted to do one of the following:

A. SURRENDER (lose 50% of BET)

B. STAY (Play BET as is)

C. DOUBLE the bet (same amount as BET)

D. Make a DRAW bet (same as amount BET)

4. If the player has SURRENDERED, dealer immediately removes half of the player's BET and cards.

5. After all the betting is complete, each remaining player flips over his cards.

6. If the player has STAYED, his 3-card hand is in play.

7. If the player has DOUBLED his bet, his 3-card hand is in play.

8. If the player has made a DRAW bet, he gets one additional card, and his hand is the best-3-of-4 cards.

9. If the draw hand does not contain at least a pair, the hand loses (dealer removes both bets and the player's cards).

10. Dealer attends to all player hands, and then flips over an additional 3 cards in his stud hand. All active hands go up against the dealer's best-3-of-5 card stud hand.

11. PAYOFFS:

BET pays multiples according to predetermined paytable.

DOUBLE pays 2× the BET multiples according to predetermined paytable.

DRAW pays 1 to 1.

Sample Paytable for Version B:

Rank Odds on BET:

PAIR 2:1

STRAIGHT 3:1

FLUSH 3:1

THREE-OF-A-KIND 6:1

STRAIGHT FLUSH 8:1

A-K-Q SUITED 10:1

Version C: 3-Card Poker Rules for 7 Players

1. Player makes an ANTE wager to play game.

2. Each player gets 3 cards face down. Dealer gets 2 cards face up. (Start deal with one card each to first base player, then the next players, then the dealer, and end with third base player.)

3. Each player is prompted to do one of the following:

A. FOLD (lose ANTE)

B. Make a PLAY bet (same amount as ANTE)

If a PLAY bet is made, the player may also do one of the following:

A. DOUBLE the PLAY bet

B. Make a DRAW bet (same as amount ANTE)

4. If the player has FOLDED, dealer immediately removes the player's ANTE and cards.

5. After all the betting is complete, each remaining player flips over his cards.

6. If the player has made a PLAY bet, his 3-card hand is in play.

7. If the player has DOUBLED his PLAY bet, his 3-card hand is in play.

8. If the player has made a DRAW bet, he gets one additional card, and his hand is the best-3-of-4 cards.

9. If the draw hand does not contain at least a pair, the hand loses (dealer removes both bets and the player's cards).

10. Dealer attends to all player hands, and then flips over an additional 3 cards in his stud hand. All active hands go up against the dealer's best-3-of-5 card stud hand.

11. PAYOFFS:

ANTE pays 1 to 1.

PLAY pays multiples according to predetermined paytable.

DOUBLE pays 2× the PLAY multiples according to predetermined paytable.

DRAW pays 1 to 1.

Sample Paytable for Version C:

Rank Odds on PLAY BET:

PAIR 1:1

STRAIGHT 2:1

FLUSH 2:1

THREE-OF-A-KIND 5:1

STRAIGHT FLUSH 7:1

A-K-Q SUITED 10:1

Although specific examples and specific paytables have been provided in this discussion, these specifics are intended to be only support for the generic concepts of the invention and are not intended to be absolute limits in the scope of the technology discussed. The game may also be played in various electronic formats, on hand-held devices and on the internet.

The game may be played as a live table game with physical cards, live player and live dealer; as a hybrid table game with live players and virtual cards and no dealer or a virtual dealer; or an electronic wagering game with single players. This could be performed on standard gaming apparatus comprising a housing having a video monitor, a processor and player input controls, the processor having software therein that enables play of the methods described herein.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A method of providing a play of a wagering game, said method comprising:

causing a processor to execute a plurality of instructions to operate with an input device and a display device to provide said play of the wagering game, by:

(a) receiving a wager from a player, and after receiving the wager from the player, (i) dealing the player three cards from a deck of cards for a player hand, and (ii) dealing two cards face up from the deck of cards for a dealer hand;

(b) after the three cards are dealt and the two cards are dealt, providing the player each of the following options:

(i) surrendering, (ii) staying, (iii) placing a double down bet, and (iv) placing a draw bet;

(c) after the player performing one of said options, if the player surrenders, providing the player a portion of the wager received from the player; and (d) after the player performing of one of said options, if the player does not surrender:

(i) if the player places the draw bet, without requiring the player to discard any of the cards of the player hand, dealing one card from the deck of cards to the player hand, (ii) dealing three cards face up from the deck of cards to the dealer hand, (iii) determining from all of the cards in the dealer hand a best three card hand using predetermined poker rankings, (iv) determining a best three card hand from all of the cards in the player hand using said predetermined poker rankings, wherein if the player places the draw bet, the determination of said best three card hand is made from all four of the cards of the player hand using said predetermined poker rankings, (v) comparing the dealer best three card hand to the player best three card hand, said comparison being made regardless of a rank of the dealer best three card hand, (vi) if the player best three card hand is a winner according to said predetermined poker rankings over the dealer best three card hand based on said comparison, and the player stayed, providing the player an award from a plurality of awards based on a predetermined paytable, (vii) if the player best three card hand is the winner according to said predetermined poker rankings over the dealer best three card hand based on the comparison, and the player placed the double down bet, providing the player one of the awards based on the predetermined paytable, and (viii) if the player best three card hand is the winner according to said predetermined poker rankings over the dealer best three card hand based on the comparison, and the player placed the draw bet, providing the player a draw bet award, said draw bet award independent of any rank of said player best three card hand in the predetermined paytable.

2. The method of claim 1, where the deck of cards is a standard 52 card deck.

3. The method claim 1, wherein the draw bet award is based on even odds.

4. The method of claim 1, which includes: if the player best three card hand is the winner according to said predetermined poker rankings over the dealer best three card hand based on the comparison, and if the player stayed, providing the player the award from the plurality of awards based on odds associated with the player best three card hand based on the predetermined paytable.

5. The method of claim 1, which includes, when the player best three card hand is the winner according to said predetermined poker rankings over the dealer best three card hand based on the comparison, and the player placed the double down bet, providing the player the award from the plurality of awards based on odds associated with the player best three card hand based on the predetermined paytable.

6. A method of providing a play of a wagering game, said method comprising:

causing a processor to execute a plurality of instructions to operate with an input device and a display device to provide said play of the wagering game, by:

(a) receiving a wager from a player, and after receiving the wager from the player, (i) dealing the player three cards from a deck of cards for a player hand, and (ii) dealing two cards face up from the deck of cards for a dealer hand;

(b) after the three cards are dealt and the two cards are dealt, providing the player each of the following options:

(i) folding, (ii) placing a double down bet, and (iii) placing a draw bet;

(c) after the player performing one of said options, and if the player does not fold:

(i) if player places the draw bet, without requiring the player to first discard one of the cards in the player hand, dealing one card face up from the deck of cards for the player hand;

(ii) dealing three cards face up for the dealer hand from the deck of cards;

(iii) determining a best three card hand from all of the cards in the dealer hand using predetermined poker rankings;

(iv) determining a best three card hand from all of the cards in the player hand using said predetermined poker rankings, wherein if the player placed the draw bet, said determination of the best three card hand is made from all four of the cards in the player hand using said predetermined poker rankings;

(v) comparing the dealer best three card hand to the player best three card hand, said comparison being made regardless of a rank of the dealer best three card hand;

(vi) if the player best three card hand is a winner according to said predetermined poker rankings, and the player placed the double down bet, providing the player an award based on a predetermined paytable; and (vii) if the player best three card hand is the winner according to said predetermined poker rankings over the dealer best three card hand based on the comparison, and the player placed the draw bet, providing the player a draw bet award, said draw bet award independent of any rank of said player best three card hand in the predetermined paytable.

7. The method of claim 6, where the deck of cards is a standard 52 card deck.

8. The method of claim 6, wherein the draw bet award is based on even odds.

9. The method claim 6, which includes: if the player best three card hand is the winner according to said predetermined poker rankings over the dealer best three card hand based on the comparison, and if the player placed the double down bet, providing the player the award from the plurality of awards based on odds associated with the player best three card hand based on the predetermined paytable.

10. A method of providing a play of a wagering game, said method comprising:

causing a processor to execute a plurality of instructions to operate with an input device and a display device to provide said play of the wagering game, by:

(a) receiving a wager from a player, and after receiving the wager from the player, (i) dealing the player three cards from a deck of cards for a player hand, and (ii) dealing two cards face up from the deck of cards for a dealer hand;

(b) after the three cards are dealt and the two cards are dealt, providing the player each of the following options:

(i) folding; and (ii) placing a play bet;

(c) after the player performing of one of said options, and if the player does not fold and places the play bet:

(i) providing the player with each of the following options:

(A) placing a double down bet, and (B) placing a draw bet, (ii) if the player places the draw bet, without requiring the player to discard any of the cards in the player hand, dealing one card face up from the deck of cards for the player hand, (iii) dealing three cards face up for the dealer hand from the deck of cards, (iv) determining a best three card hand from all of the cards in the dealer hand using predetermined poker rankings, (v) determining a best three card hand from all of the cards in the player hand using said predetermined poker rankings, wherein if the player placed the draw bet, said determination of the best three card hand is made from all four of the cards in the player hand using said predetermined poker rankings, (vi) comparing the dealer best three card hand to the player best three card hand, said comparison being made regardless of a rank of the dealer best three card hand, (vii) if the player best three card hand is a winner according to said predetermined poker rankings over the dealer best three card hand based on the comparison, and the player did not place the double down bet or the draw bet, providing the player an award from a plurality of awards based on a predetermined paytable;

(ix) if the player best three card hand is the winner according to said predetermined poker rankings over the dealer best three card hand based on the comparison, and the player placed the double down bet, provide the player one of the awards based on the predetermined paytable; and (x) if the player best three card hand is the winner according to said predetermined poker rankings over the dealer best three card hand based on the comparison, and the player placed the draw bet, providing the player a draw bet award, said draw bet award independent of any rank of said player best three card hand in the predetermined paytable.

11. The method of claim 10, where the deck of cards is a standard 52 card deck.

12. The method of claim 10, which includes: if the player best three card hand is the winner according to said predetermined poker rankings over the dealer best three card hand based on the comparison, and if the player placed the play bet but the player did not place the double down bet or the draw bet, providing the player the award from the plurality of awards based on odds associated with the player best three card hand based on the predetermined paytable.

13. The method of claim 10, which includes: if the player best three card hand is the winner according to said predetermined poker rankings over the dealer best three card hand based on the comparison, and if the player placed the double down bet, providing the player the award from the plurality of awards based on odds associated with the player best three card hand based on the predetermined paytable.

14. The method of claim 10, wherein the draw bet award is based on even odds.

* * * * *

UNITED STATES PATENT AND TRADEMARK OFFICE

CERTIFICATE OF CORRECTION

PATENT NO. : 8,177,619 B2
APPLICATION NO. : 12/844145
DATED : May 15, 2012
INVENTOR(S) : Kathleen Nylund Jackson It is certified that error appears in the above-identified patent and that said Letters Patent is hereby corrected as shown below:

IN THE CLAIMS

In Claim 1, Column 9, Line 37, delete the “,”.
In Claim 1, Column 9, Lines 50 and 53, replace “performing” with --performs--.
In Claim 5, Column 10, Line 41, replace “award from the plurality of” with --one of the--.
In Claim 6, Column 10, Line 48, delete the “,”.
In Claim 6, Column 10, Line 59, after “;” insert --and--.
In Claim 6, Column 10, Line 60, replace “performing” with --performs-- and delete “and”.
In Claim 9, Column 11, Line 35, delete “from the plurality of awards.”.
In Claim 10, Column 11, Line 42, delete the “,”.
In Claim 10, Column 11, Line 52, after “;” insert --and--.
In Claim 10, Column 11, Line 53, replace “performing” with --performs--.
In Claim 10, Column 12, Line 26, replace “(ix)” with --(viii)--.
In Claim 10, Column 12, Line 32, replace “(x)” with --(ix)--.
In Claim 13, Column 12, Line 52, replace “award from the plurality of” with --one of the--.

Signed and Sealed this
Eighteenth Day of September, 2012

David J. Kappos

David J. Kappos
*Director of the United States Patent and Trademark Office*